US006682400B2

(12) United States Patent
Draper

(10) Patent No.: US 6,682,400 B2
(45) Date of Patent: Jan. 27, 2004

(54) SANDING BLOCK WITH ANCHORING BAR

(75) Inventor: Zhaun Draper, 1344 Elizabeth Cir. #2, Idaho Falls, ID (US) 83404

(73) Assignee: Zhaun Draper, Pleasant Grove, UT (US)

( * ) Notice: Subject to any disclaimer, the term of this patent is extended or adjusted under 35 U.S.C. 154(b) by 70 days.

(21) Appl. No.: 09/754,886

(22) Filed: Jan. 5, 2001

(65) Prior Publication Data

US 2002/0090902 A1 Jul. 11, 2002

(51) Int. Cl.[7] ..... B24B 1/00

(52) U.S. Cl. ..... 451/28; 451/495; 451/499; 451/502; 451/503; 451/512; 451/523

(58) Field of Search ..... 451/28, 495, 499, 451/502, 503, 512, 523

(56) References Cited

U.S. PATENT DOCUMENTS 2,531,588 A * 5/1950 Stucker ..... 451/512
3,410,035 A 11/1968 Gohde
3,510,991 A * 5/1970 Bowen ..... 451/504
4,640,060 A 2/1987 Lukianoff
4,918,875 A 4/1990 Klocke
5,168,672 A 12/1992 Grégoire, Sr.
5,383,308 A 1/1995 Beloff et al.
5,522,763 A 6/1996 Regnier
D392,868 S 3/1998 Ansalvish
D406,514 S 3/1999 Ali
D417,131 S 11/1999 Peters et al.
5,997,221 A 12/1999 Sadler
6,196,909 B1 * 3/2001 Cadrobbi ..... 451/499

* cited by examiner

*Primary Examiner*—Joseph J. Hail, III
*Assistant Examiner*—Shantese McDonald
(74) *Attorney, Agent, or Firm*—Clayton, Howarth & Cannon, P.C.

(57) ABSTRACT

A sanding device for use with abrasive sheet material. The device has a body with a rounded side for sanding concave recesses, sharp corner edges for use in sanding ninety-degree corners, and flat surfaces for sanding planar areas. Abrasive sheet material is attached to the body by an anchor strip which fits into a groove in the body to cause a friction fit.

95 Claims, 3 Drawing Sheets

SANDING BLOCK WITH ANCHORING BAR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. The Field of the Invention

The present invention relates generally to the field of hand tools, and more particularly, but not necessarily entirely, to a hand held sanding device for use with abrasive sheet material.

2. Description of Related Art

Sanding blocks are well known tools for use in holding sandpaper while sanding by hand. Sanding blocks allow uniform pressure to be applied to the sandpaper and provide a solid surface for a user to grip.

There are several types of sanding blocks known in the prior art, such as that disclosed in U.S. Pat. No. 5,522,763 (granted Jun. 4, 1996 to Regnier). This patent discloses a sanding block having a generally rectangular configuration with a groove extending along the entire length of a side. A piece of sandpaper is secured to the block by forming six folds in the sheet of sandpaper and sliding the sheet over the block with two opposing edges in the groove. All of the sides of the sanding block are flat, making it difficult to sand curved recesses. Also, installation of the sandpaper is difficult since precise folding is required. Furthermore, the sandpaper is not positively held to the block. Thus, the sandpaper is capable of moving with respect to the block and unintended release of the sandpaper is possible.

Another sanding device, disclosed in U.S. Pat. No. 4,918,875 (granted Apr. 24, 1990 to Klocke), has a cylindrical body and means for holding sandpaper to the body. However, the cylindrical shape makes sanding flat surfaces difficult since the shape is unstable. The cylindrical body tends to roll rather than grip the surface. Similarly, the user's hand tends to roll when a force is applied during sanding.

U.S. Pat. No. 4,640,060 (granted Feb. 3, 1987 to Lukianoff) discloses a sanding device with two flat sides and a rounded side. A slot is provided on the rounded side for receiving two ends of a sheet of sandpaper. The sandpaper is not positively held in the slot allowing the sandpaper to move relative to the device. Also, the three sided shape is awkward for handling and applying sanding forces to the device.

Finally, U.S. Patent No. Des. 417,131 (granted Nov. 30, 1999 to Peters et al.) discloses a sanding block with a rectangular shape and a wedge system for holding the sandpaper on the block. The wedge pivots about one end of the block to wedge a sheet of sandpaper in a slot formed along the entire length of the block. However, the block must be longer than the sheet of sandpaper to provide space for the wedge to be attached to the block. Also, this sanding block does not have a rounded surface for sanding curved recesses, and the wedge is limited in its application.

The prior art is thus characterized by several disadvantages that are addressed by the present invention. The present invention minimizes, and in some aspects eliminates, the above-mentioned failures, and other problems, by utilizing the methods and structural features described herein.

In view of the drawbacks inherent in the available art, it would be a significant advance in the art to provide a sanding device which is simple in design and manufacture, and which is capable of being used to sand curved recesses, corners, and planar surfaces. It would also be an advancement in the art to provide a sanding device which provides a stable surface for applying a sanding force and provides for secure attachment of abrasive sheet materials having different thicknesses.

BRIEF SUMMARY AND OBJECTS OF THE INVENTION

It is therefore an object of the present invention to provide a sanding device which is simple in design and manufacture.

It is another object of the present invention to provide such a sanding device arranged to better facilitate the sanding of curved recesses.

It is an additional object of the present invention to provide a sanding device which is arranged to facilitate the sanding of corners.

It is a further object of the present invention, in accordance with one aspect thereof, to provide a sanding device arranged to facilitate the sanding of flat surfaces.

It is another object of the present invention to provide a sanding device which provides a stable surface for applying a sanding force.

It is an additional object of the invention to provide a sanding device which provides for a more secure attachment of abrasive sheet material.

It is a further object of the invention, in accordance with one aspect thereof, to provide a sanding device which provides an adjustment feature for attaching abrasive sheet materials of different thicknesses.

The above objects and others not specifically recited are realized in a specific illustrative embodiment of a sanding device. The device includes a body having a top, a bottom, a first side, a second side, a first end, and a second end. The top, bottom and first side form flat surfaces. The second side is rounded for sanding curved recesses. The first side has attaching means for attaching abrasive sheet material to the body.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
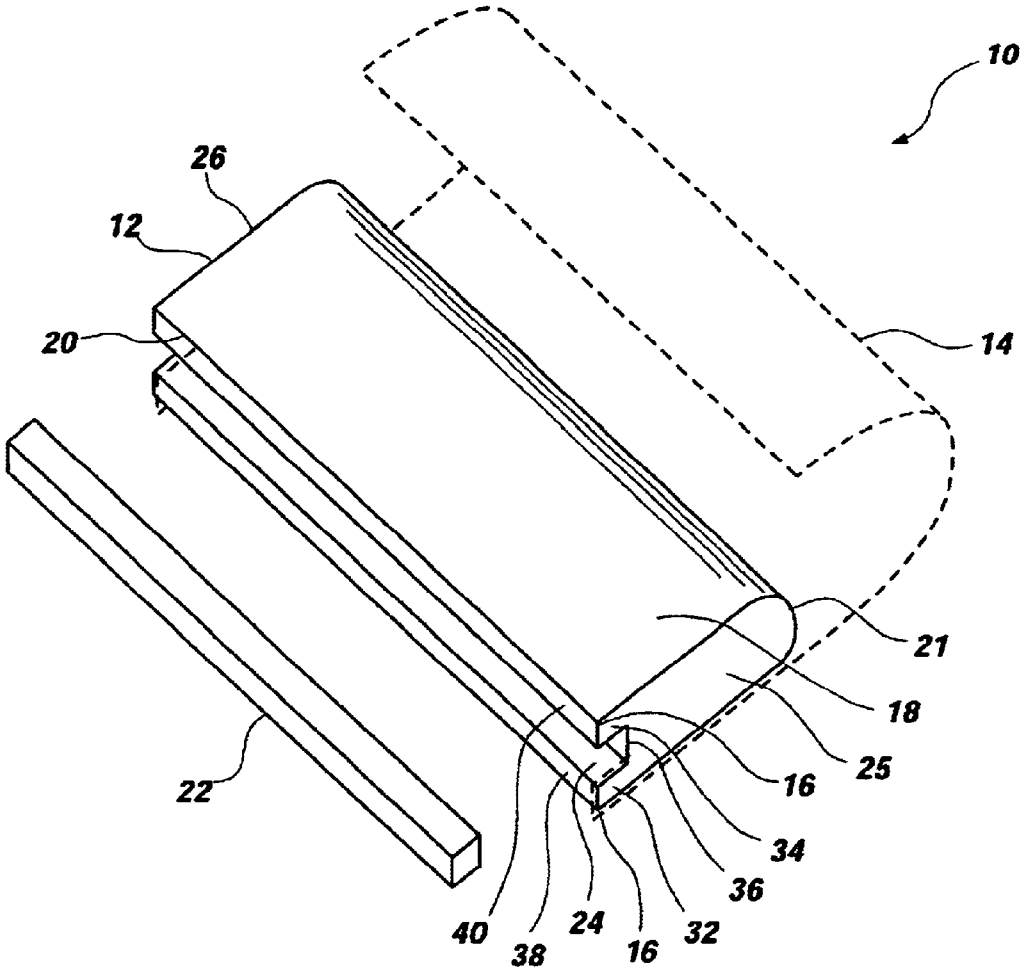
FIG. 1 is a perspective view of a sanding device made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Before the presently preferred embodiments of the inventions are disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice are hereby incorporated by reference herein. The references discussed herein are provided solely for their disclosure prior to the filing date of the present application. Nothing herein is to be construed as a suggestion or admission that the inventors are not entitled to antedate such disclosure by virtue of prior invention.

It must be noted that, as used in this specification and the appended claims, the singular forms a, "an," and "the" include plural referents unless the context clearly dictates otherwise.

Referring now to FIG. 1, a sanding device in accordance with the present invention is shown generally at 10. The sanding device includes a body 12 having a top 18, a bottom 19, a first side 20, a second side 21, a first end 25 and a second end 26. The first side 20 of the body includes attaching means for attaching abrasive sheet material 14 to the body 12. The abrasive sheet material 14 is preferably sandpaper or sanding screen, however, any other suitable abrasive material known in the art can be used. The attaching means for attaching abrasive sheet material 14 to the body includes an elongate anchor strip 22 and a groove or elongate opening 24. Anchor strip 22 is removably disposed on the body 12 for anchoring the abrasive sheet material to the body along the entire length of the first side. The second side 21 of body 12 includes a rounded edge configured to sand concave recesses. The top 18 and bottom 19 are planar surfaces suited for sanding flat areas. Body 12 also has sharp corner edges 16, also referred to as elongate corners, for use in sanding ninety-degree angles. Preferably, the top 18 and bottom 19 provide a flat area of at least 1.5 inches by 6 inches. First side 20 forms a ninety-degree angle with the top 18 and bottom 19 and is preferably dimensioned at 0.75 inch. These dimensions are configured for advantageous characteristics of the sanding device such as providing a configuration that can be comfortably gripped and easily manipulated while providing appropriate surface areas to sand large planar areas and small curved areas. However, it will be appreciated that other dimensions can be used within the scope of the invention.

The elongate opening 24 is defined by first and second opposing sidewalls 32, 34 that are inter-coupled by a bottom wall 36. The elongate opening 24 is configured and dimensioned to receive the elongate anchor strip 22 such that receiving gaps 30 reside between the sidewalls 32, 34 and the anchor strip 22, respectively. The elongate opening 24 resides substantially equidistantly between the top surface 18 and the bottom surface 19 of the sanding device 10.

The body 12 also comprises first and second opposing ledges 38, 40 that are formed in part by the first and second opposing sidewalls 32, 34, respectively. A width of the elongate opening 24 is preferably equivalent to a width of at least one of the ledges 38, 40. Preferably, an average width of the elongate opening 24 is equivalent to an average width of both of the ledges 38, 40, such that the elongate opening 24 and the first and second ledges 38, 40 all have substantially equivalent average widths.

In one embodiment of the invention, the anchor strip 22 is separate from, and unattached to, the body 12, such that the anchor strip 22 is removably insertable into the elongate opening 24 formed in the first side 20 of the body 12. The anchor strip 22 may also be characterized by an absence of any openings or recesses formed therein. The second side 21 of the body 12 is rounded such that a boundary of the rounded portion forms a partial circle, and a radius of curvature of the rounded portion is that of a circle. The first side 20 of the body 12 forms elongate corners 16 with the top surface 18 and the bottom surface 19. At least a majority of the elongate corners 16 are characterized by an absence of rounding to facilitate sanding angled surfaces.

The shape of body 12 provides advantages in that body 12 includes the combination of rounded side 21 suited for sanding concave recesses, planar top 18 and bottom 19 useful in sanding flat surfaces, and sharp corner edges 16 for use in sanding ninety-degree angles. The configuration allows sanding of curved recesses without having a completely round shape which would roll on sloped surfaces. Furthermore, top 18 and bottom 19 provide stable surfaces for applying sanding forces without causing the device to roll.

Body 12 is made of a material which is solid, rigid, hard and has a low coefficient of thermal expansion, such as plastic or poly propylene. The hardness, rigidity and low coefficient of thermal expansion cause the body to be more durable so that the corner edges 16 stay sharp. This facilitates sanding of angled corners over longer periods of use. Although plastic and poly propylene are preferred materials, it will be appreciated that other suitable materials can be used within the scope of the present invention.

In use, an edge of a sheet of sandpaper 14 is inserted into groove 24. The sandpaper is then folded to conform to the shape of the body and the opposite edge is also inserted into groove 24. Anchoring strip 22 is then inserted into groove 24 to frictionally hold the sandpaper on the body. When desired, the anchoring strip 22 may be slid out of the groove 24 to remove the sandpaper 14. It will be appreciated that sandpaper of varying roughness may be used in the present invention.

The invention disclosed herein thus provides a method of attaching a planar piece of abrasive sheet material to a sanding device comprising the steps of: joining the abrasive sheet material to the body at groove 24; forming a first ninety-degree angle in the abrasive sheet material at 16; forming a first surface area at least 6 inches in length and 1.5 inches in width at either top 18 or bottom 19; forming a convex rounded area at 21; forming a second surface area at least 6 inches in length and 1.5 inches in width at the other of top 18 or bottom 19; forming a second ninety-degree angle in the abrasive sheet material at 16; and using attaching means for attaching the abrasive sheet material to the device.

Figure 3A:
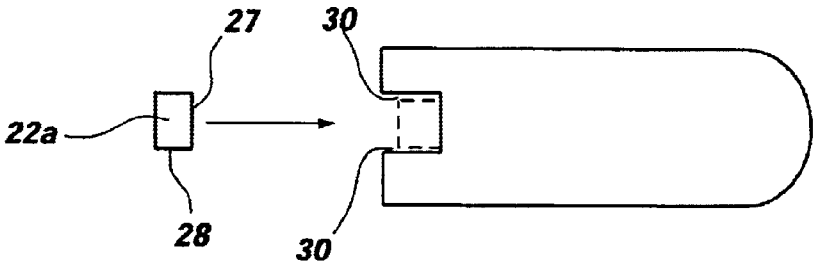
FIG. 3*a* is a side view of an alternative embodiment of the sanding device of FIG. 1, with an anchor strip adjusted for securing a thin piece of abrasive sheet material.
Figure 3B:
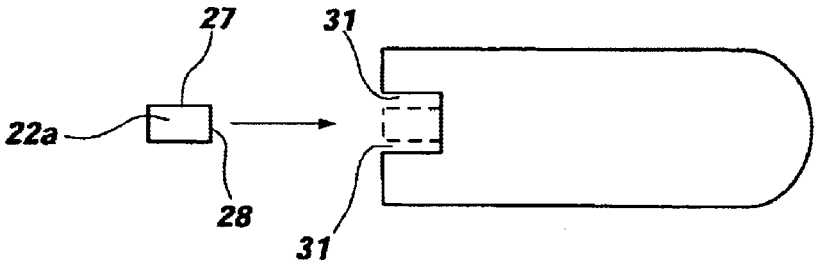
FIG. 3*b* is a side view of the embodiment of FIG. 3*a*, in which the anchor strip has been rotated ninety degrees to enable the securing of a thick piece of abrasive sheet material.

Reference will now to made to FIGS. 3*a* and 3*b* to describe a second embodiment of the present invention. As previously discussed, the presently preferred embodiments of the invention illustrated herein are merely exemplary of the possible embodiments of the invention, including that illustrated in FIGS. 3*a* and 3*b*.

Figure 2:
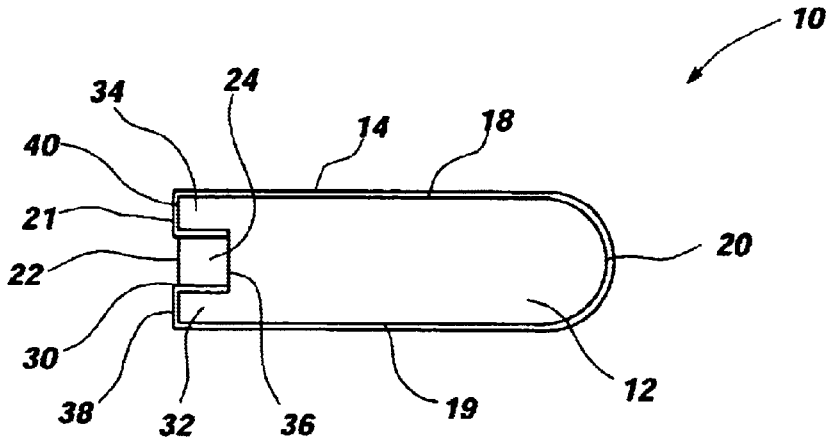
FIG. 2 is a side view of a sanding device made in accordance with the principles of the present invention.

It will be appreciated that the second embodiment of the invention illustrated in FIGS. 3*a* and 3*b* contains many of the same structures represented in FIGS. 1–2 and only the new or different structures will be explained to most succinctly explain the additional advantages which come with the embodiments of the invention illustrated in FIGS. 3*a* and 3*b*. The second embodiment of the invention includes adjustable attaching means in the form of an anchoring strip 22*a* having a rectangular cross section with a first dimension or width 27 which is longer than a second dimension or thickness 28. In FIG. 3*a*, the anchor strip is inserted into groove 24 such that the longer first dimension 27 spans the opening of the groove 24. This orientation of anchoring strip 22*a* provides a narrow gap 30 between the top and bottom of anchor strip 22*a* and body 12. Narrow gap 30 allows a secure friction fit between anchoring strip 22*a*, abrasive sheet material 14, and body 12 when a thin sheet of abrasive sheet material is used.

If a thicker sheet of abrasive sheet material is used, the anchor strip 22*a* can be inserted into groove 24 as shown in FIG. 3*b*. In FIG. 3*b*, the anchor strip 22*a* is inserted into groove 24 with the shorter dimension 28 spanning the groove opening. This orientation of anchor strip 22*a* provides a wider gap 31 between the top and bottom of anchor strip 22*a* and body 12. The wider gap 31 allows a thicker sheet of abrasive sheet material to be secured to the sanding device.

Figure 4:
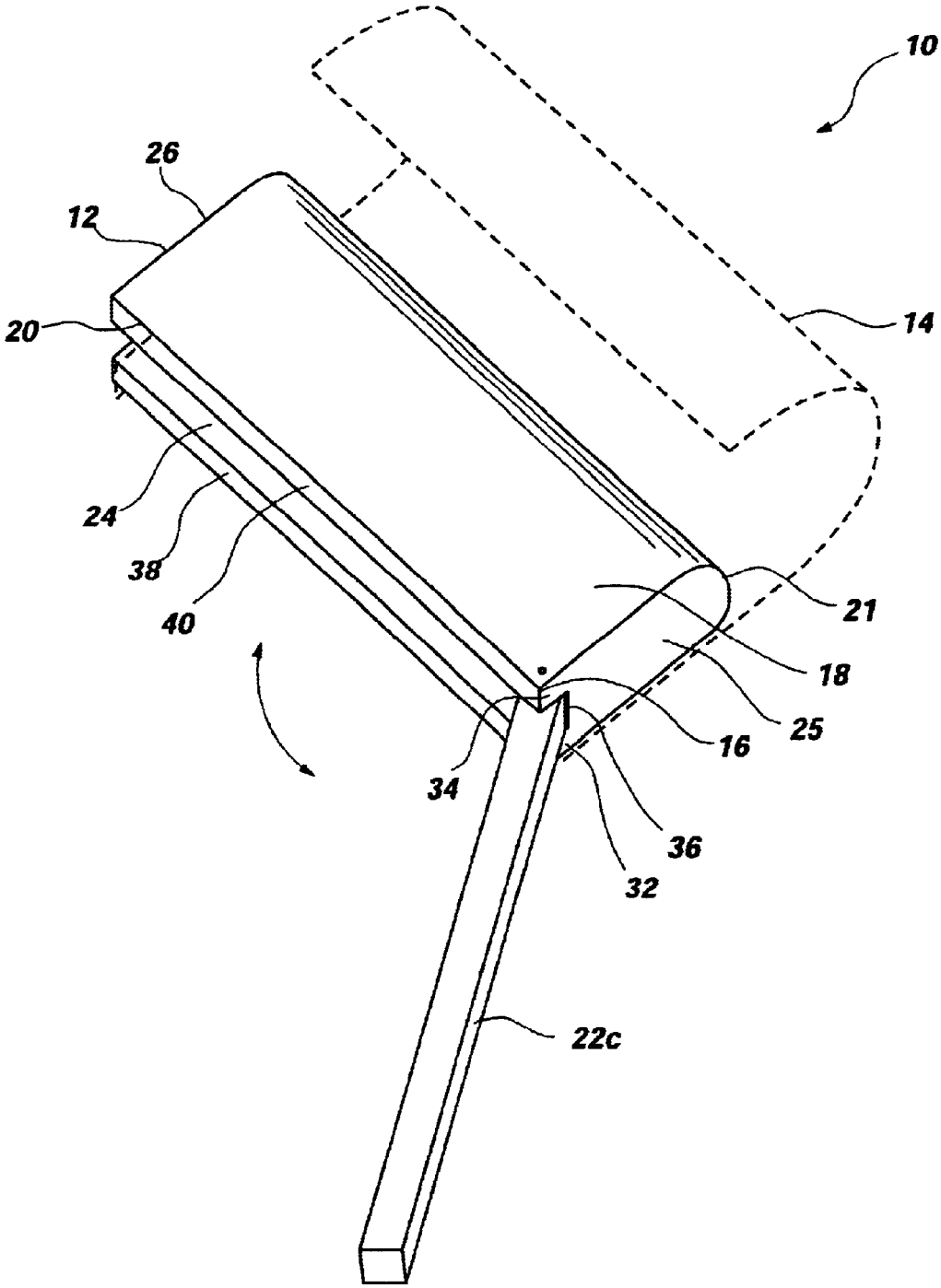
FIG. 4 is a perspective view of another alternative embodiment of the sanding device, with a pivotally connected anchor strip.

Reference will now to made to FIG. 4 to describe a third embodiment of the present invention. As previously discussed, the presently preferred embodiments of the invention illustrated herein are merely exemplary of the possible embodiments of the invention, including that illustrated in FIG. 4.

It will be appreciated that the third embodiment of the invention illustrated in FIG. 4 contains many of the same structures represented in FIGS. 1–3 and only the new or different structures will be explained to most succinctly explain the additional advantages which come with the embodiments of the invention illustrated in FIG. 4. The third embodiment of the invention includes a pivotally attached anchor strip 22*c*. Pivotally attached anchor strip 22*c* is automatically aligned as it rotates from an open position to a position in which it fits into groove 24 to secure abrasive sheet material 14 to the body 12.

In view of the foregoing, it will be appreciated that the present invention provides a sanding device which is simple in design and manufacture, and which is capable of being used to sand curved recesses, corners, and planar surfaces. The present invention also provides a sanding device which has a stable surface for applying a sanding force, and provides for secure attachment of abrasive sheet materials having different thicknesses.

A method of attaching abrasive sheet matieral to a sanding device, in accordance with the principles of the present invention, comprises:

(A) selecting a first piece of abrasive sheet material having a first thickness;

(B) securing said first piece of abrasive sheet material to said sanding device with anchoring means;

(C) removing said first piece of abrasive sheet material and said anchoring means from said sanding device;

(D) selecting a second piece of abrasive sheet material having a second thickness;

(E) rotating said anchoring means; and (F) securing said second piece of abrasive sheet material to said sanding device with said anchoring means.

A method of sanding with a sanding device, in accordance with the principles of the present invention, comprises:

(A) sanding a planar surface with a first surface of said sanding device;

(B) rotating the sanding device about a longitudinal axis of said sanding device;

(C) sanding a concave surface with a second surface of said sanding device;

(D) repeating step (B); and (E) sanding a 90 degree corner with a third surface and a fourth surface of said sanding device.

It will be appreciated that the structure and apparatus disclosed herein is merely one example of attaching means for attaching abrasive sheet material to a body, and it should be appreciated that any structure, apparatus or system for attaching abrasive sheet material to a body which performs functions the same as, or equivalent to, those disclosed herein are intended to fall within the scope of attaching means for attaching abrasive sheet material to a body, including those structures, apparatus or systems for attaching abrasive sheet material to a body which are presently known, or which may become available in the future. Anything which functions the same as, or equivalently to, attaching means for attaching abrasive sheet material to a body falls within the scope of this element. Other examples of attaching means for attaching abrasive sheet material to a body include, but are not limited to, slots, adhesives, and fasteners.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A sanding device comprising:

an elongate body having a length bounded by a first end and an opposing second end, and a width bounded by a first side and an opposing second side, and a thickness bounded by a top surface and a bottom surface, wherein the first side is substantially planer and wherein the opposing second side is rounded;

attaching means for attaching opposing ends of a sheet of abrasive material to the first side of the body with said sheet of abrasive material wrapped about the body, such that said attaching means are characterized by an absence of a portion protruding away from said body beyond said first side when said attaching means are attached to said body;

wherein said top surface and said bottom surface comprise an area that is larger than an area defined by said first side and said second side, such that said top surface and said bottom surface provide stable surfaces for applying sanding forces without causing the sanding device to roll;

wherein the attaching means further comprises an elongate anchor strip;

wherein the first side of the body has an elongate opening formed therein, said elongate opening being defined by first and second opposing sidewalls that are intercoupled by a bottom wall, said elongate opening being configured and dimensioned to receive the elongate anchor strip thereinto such that receiving gaps reside between the sidewalls and the anchor strip, respectively;

wherein the anchor strip is separate from, and unattached to, the body, such that the anchor strip is removably insertable into the elongate opening formed in the first side of the body.

2. The sanding device of claim 1, wherein the elongate opening resides substantially equidistantly between the top surface and the bottom surface of the sanding device.

3. The sanding device of claim 1, wherein the body further comprises first and second opposing ledges that are formed in part by the first and second opposing sidewalls, respectively.

4. The sanding device of claim 3, wherein a width of the elongate opening is equivalent to a width of at least one of the ledges.

5. The sanding device of claim 4, wherein an average width of the elongate opening is equivalent to an average width of both of the ledges, such that said elongate opening and the first and second ledges all have substantially equivalent average widths.

6. The sanding device of claim 1, wherein the anchor strip has a rectangular cross-section.

7. The sanding device of claim 1, wherein the anchor strip is characterized by an absence of any openings formed therein.

8. The sanding device of claim 1, wherein the anchor strip is characterized by an absence of any openings or recesses formed therein.

9. The sanding device of claim 1, wherein the second side of the body is rounded such that a boundary of the rounded portion forms a partial circle, wherein a radius of curvature of said rounded portion is that of a circle.

10. The sanding device of claim 1, wherein the first side of the body forms an elongate corner with the top surface and the bottom surface, and wherein at least a majority of said elongate corner is characterized by an absence of rounding.

11. The sanding device of claim 1, wherein the top surface and the bottom surface are substantially planer.

12. The sanding device of claim 1, wherein said sanding device is constructed of a solid plastic material.

13. The sanding device of claim 1, wherein said elongate anchor strip is sized to hold the abrasive material in the elongate opening with a friction fit.

14. The sanding device of claim 1, wherein said top surface and said bottom surface have a width of approximately 1½ inches.

15. The sanding device of claim 1 wherein said thickness has a dimension of approximately ¾ inch.

16. The sanding device of claim 1, wherein the anchor trip has a length, a width, and a thickness, and wherein the width is substantially equal to the thickness, such that the receiving gaps are substantially the same size when the anchor strip resides with its width spanning the elongate opening, as when the anchor strip resides with its thickness spanning the elongate opening.

17. The sanding block of claim 1, wherein the attaching means is configured for attaching said abrasive material to said body along the entire length of the body.

18. The sanding block of claim 1, wherein the length of the anchor strip is no longer than the length of the body such that when the anchor strip resides in the elongate opening, the anchor strip does not protrude outside of the elongate opening.

19. The sanding block of claim 18, wherein the anchor strip is characterized by an absence of any openings or recesses formed therein.

20. The sanding block of claim 1, wherein the anchor strip has a length, a width, and a thickness, and wherein the width is substantially equal to the thickness, such that the receiving gaps are substantially the same size when the anchor strip resides with its width spanning the elongate opening, as when the anchor strip resides with its thickness spanning the elongate opening;

wherein the attaching means is configured for attaching said abrasive material to said body along the entire length of the body;

wherein the length of the anchor strip is no longer than the length of the body such that when the anchor strip resides in the elongate opening, the anchor strip does not protrude outside of the elongate opening;

wherein the anchor strip is characterized by an absence of any openings or recesses formed therein; and wherein said top surface and said bottom surface have a width of approximately 1½ inches, and wherein said thickness has a dimension of approximately ¾ inch.

21. A sanding device comprising:

an elongate body having a length bounded by a first end and an opposing second end, and a width bounded by a first side and an opposing second side, and a thickness bounded by a top surface and a bottom surface, wherein the first side is substantially planer and wherein the opposing second side is rounded;

attaching means for attaching opposing ends of a sheet of abrasive material to the first side of the body with said sheet of abrasive material wrapped about the body;

wherein the attaching means further comprises an elongate anchor strip;

wherein the first side of the body has an elongate opening formed therein, said elongate opening being defined by first and second opposing sidewalls that are intercoupled by a bottom wall, said elongate opening being configured and dimensioned to receive the elongate anchor strip thereinto such that receiving gaps reside between the sidewalls and the anchor strip, respectively;

wherein the anchor strip has a length, a width, and a thickness, and wherein the width is greater than the thickness, such that the receiving gaps are smaller when the anchor strip resides with its width spanning the elongate opening, and the receiving gaps are larger when the anchor strip resides with its thickness spanning the elongate opening.

22. A sanding device for use with abrasive sheet material, said sanding device comprising:

a body having a top, a bottom, a first side, a second side, a first end, and a second end, said first side forming a right angle with said top and said bottom for sanding corners, said second side being rounded for sanding curved recesses;

wherein said sanding device further comprises attaching means for attaching said abrasive sheet material to said body;

wherein said attaching means for attaching said abrasive sheet material to said body comprises a groove in said body and an anchoring strip for holding the abrasive sheet material in the groove;

wherein the first side of the body has said groove formed therein, said groove being defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

23. The sanding device of claim 22, wherein said anchoring strip is sized to hold the abrasive sheet material the groove with a friction fit.

24. The sanding device of claim 22, wherein the anchoring strip is insertable in the groove to grip the abrasive sheet material for attachment to the groove, and the anchoring strip is removable from the groove to change the abrasive sheet material.

25. The sanding device of claim 22, wherein the anchoring strip has a rectangular cross section.

26. The sanding device of claim 22 wherein said top and said bottom have a width of approximately 1½ inches.

27. The sanding device of claim 22, wherein said thickness has a dimension of approximately ¾ inch.

28. The sanding device of claim 22 wherein said body is constructed of a solid plastic material.

29. The sanding device of claim 22, wherein the body further comprises first and second opposing ledges that are formed in part by the first and second opposing sidewalls, respectively.

30. The sanding device of claim 22, wherein the second side of the body is rounded such that a boundary of the rounded portion forms a partial circle, wherein a radius of curvature of said rounded portion is that of a circle.

31. The sanding device of claim 22, wherein the first side of the body forms an elongate corner with the top and the bottom, and wherein at least a majority of said elongate corner is characterized by an absence of rounding.

32. A sanding device for use with abrasive sheet material, said sanding device comprising:

a body having a top, a bottom, a first side, a second side, a first end, and a second end, said top and bottom forming flat surfaces, said second side being rounded for sanding curved recesses; and attaching means for attaching said abrasive sheet material to said body;

wherein said attaching means for attaching said abrasive sheet material to said body comprises a groove in said body and an anchoring strip for holding the abrasive sheet material in the groove;

wherein the first side of the body has said groove formed therein, said groove being defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

33. The sanding device of claim 32 wherein at least a portion of the attaching means is formed in the first side.

34. The sanding device of claim 32, wherein said anchoring strip is sized to hold the abrasive sheet material in the groove with a friction fit.

35. The sanding device of claim 32, wherein the anchoring strip is insertable in the groove to grip the abrasive sheet material for attachment to the groove, and the anchoring strip is removable from the groove to change the abrasive sheet material.

36. The sanding device of claim 32, wherein the anchoring strip has a rectangular cross section.

37. The sanding device of claim 1 wherein the anchoring strip is pivotably mounted to the body.

38. The sanding device of claim 32 wherein said top and said bottom have a width of approximately 1½ inches.

39. The sanding device of claim 32, wherein said thickness has a dimension of approximately ¾ inch.

40. The sanding device of claim 32 wherein said body is constructed of a solid plastic material.

41. The sanding device of claim 32, wherein the body further comprises first and second opposing ledges that are formed in part by the first and second opposing sidewalls, respectively.

42. The sanding device of claim 32, wherein the second side of the body is rounded such that a boundary of the rounded portion forms a partial circle, wherein a radius of curvature of said rounded portion is that of a circle.

43. The sanding device of claim 32, wherein the first side of the body forms an elongate corner with the top and the bottom, and wherein at least a majority of said elongate corner is characterized by an absence of rounding.

44. A sanding device for use with abrasive sheet material, said sanding device comprising:

a body having a top, a bottom, a first side, an opposing second side, a first end, and a second end, said first side being flat and having attaching means for attaching said abrasive sheet material to said body, said second side being rounded to allow sanding of a curved recess;

wherein said attaching means for attaching said abrasive sheet material to said body comprises a groove in said body and an anchoring strip for holding the abrasive sheet material in the groove;

wherein the first side of the body has said groove formed therein, said groove being defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

45. The sanding device of claim 44, wherein said anchoring strip is sized to hold the abrasive sheet material in the groove with a friction fit.

46. The sanding device of claim 44, wherein the anchoring strip is insertable in the groove to grip the abrasive sheet material for attachment to the groove, and the anchoring strip is removable from the groove to change the abrasive sheet material.

47. The sanding device of claim 44, wherein the anchoring strip has a rectangular cross section.

48. The sanding device of claim 44 wherein said top and said bottom have a width of approximately 1½ inches.

49. The sanding device of claim 44 wherein said thickness has a dimension of approximately ¾ inch.

50. The sanding device of claim 44 wherein said body is constructed of a solid plastic material.

51. The sanding device of claim 44, wherein the body further comprises first and second opposing ledges that are formed in part by the first and second opposing sidewalls, respectively.

52. The sanding device of claim 44, wherein the second side of the body is rounded such that a boundary of the rounded portion forms a partial circle, wherein a radius of curvature of said rounded portion is that of a circle.

53. The sanding device of claim 44, wherein the first side of the body forms an elongate corner with the top and the bottom, and wherein at least a majority of said elongate corner is characterized by an absence of rounding.

54. A sanding device for use with abrasive sheet material, said sanding device comprising:

a body having a top, a bottom, a first side, a second side, a first end, and a second end, said first side forming a flat surface; and an anchoring strip removably disposed on said first side for anchoring said abrasive sheet material to said body along the entire length of the first side;

wherein said first side comprises a groove for receiving said anchoring strip;

wherein said groove is defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

55. The sanding device of claim 54, wherein said anchoring strip is sized to hold the abrasive sheet material in the groove with a friction fit.

56. The sanding device of claim 54, wherein the anchoring strip is insertable in the groove to grip the abrasive sheet material for attachment to the groove, and the anchoring strip is removable from the groove to change the abrasive sheet material.

57. The sanding device of claim 54 wherein the anchoring strip has a rectangular cross section.

58. The sanding device of claim 54 wherein said top and said bottom have a width of approximately 1½ inches.

59. The sanding device of claim 54, wherein said thickness has a dimension of approximately ¾ inch.

60. The sanding device of claim 54 wherein said body is constructed of a solid plastic material.

61. The sanding device of claim 54, wherein the body further comprises first and second opposing ledges that are formed in part by the first and second opposing sidewalls, respectively.

62. The sanding device of claim 54, wherein the second side of the body is rounded such that a boundary of the rounded portion forms a partial circle, wherein a radius of curvature of said rounded portion is that of a circle.

63. The sanding device of claim 54, wherein the first side of the body forms an elongate corner with the top and the bottom, and wherein at least a majority of said elongate corner is characterized by an absence of rounding.

64. A sanding device for use with abrasive sheet material, said sanding device comprising:

a body having a groove; and an anchoring strip;

wherein said groove is defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

65. The sanding device of claim 64, wherein said body comprises a top, a bottom, a first side, a second side, a first end, and a second end, said first side comprising said groove for receiving said anchoring strip.

66. The sanding device of claim 64 wherein said anchoring strip is sized to hold the abrasive sheet material in the groove with a friction fit.

67. The sanding device of claim 65 wherein the anchoring strip is insertable in the groove to grip the abrasive sheet material for attachment to the groove, and the anchoring strip is removable from the groove to change the abrasive sheet material.

68. The sanding device of claim 65 wherein said top and said bottom have a width of approximately 1½ inches.

69. The sanding device of claim 65 wherein said thickness has a dimension of approximately ¾ inch.

70. The sanding device of claim 65, wherein the body further comprises first and second opposing ledges that are formed in part by the first and second opposing sidewalls, respectively.

71. The sanding device of claim 65, wherein the second side of the body is rounded such that a boundary of the rounded portion forms a partial circle, wherein a radius of curvature of said rounded portion is that of a circle.

72. The sanding device of claim 65, wherein the first side of the body forms an elongate corner with the top and the bottom, and wherein at least a majority of said elongate corner is characterized by an absence of rounding.

73. The sanding device of claim 64 wherein the anchoring strip has a rectangular cross section.

74. The sanding device of claim 64 wherein said body is constructed of a solid plastic material.

75. A sanding device for use with abrasive sheet material, said sanding device comprising:

a body; and adjustable attaching means for selectively attaching any of a plurality of different versions of abrasive sheet material to the body, each version varying in thickness;

wherein said body comprises a top, a bottom, a first side, a second side, a first end, and a second end, said adjustable attaching means being disposed on said first side;

wherein said adjustable attaching means comprises an anchoring strip and a groove disposed on said body for receiving said anchoring strip;

wherein the first side of the body has said groove formed therein, said groove being defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

76. The sanding device of claim 75, wherein said anchoring strip is sized to hold the abrasive sheet material in the groove with a friction fit.

77. The sanding device of claim 75, wherein the anchoring strip is insertable in the groove to grip the abrasive sheet material for attachment to the groove, and the anchoring strip is removable from the groove to change the abrasive sheet material.

78. The sanding device of claim 75, wherein the anchoring strip has a rectangular cross section.

79. The sanding device of claim 75, wherein said top and said bottom have a width of approximately 1½ inches.

80. The sanding device of claim 75, wherein said thickness has a dimension of approximately ¾ inch.

81. The sanding device of claim 75 wherein said body is constructed of a solid plastic material.

82. The sanding device of claim 75, wherein the body further comprises first and second opposing ledges that are formed in part by the first and second opposing sidewalls, respectively.

83. The sanding device of claim 75, wherein the second side of the body is rounded such that a boundary of the rounded portion forms a partial circle, wherein a radius of curvature of said rounded portion is that of a circle.

84. The sanding device of claim 75, wherein the first side of the body forms an elongate corner with the top and the bottom, and wherein at least a majority of said elongate corner is characterized by an absence of rounding.

85. A sanding device for use with planar abrasive sheet material, said sanding device comprising:

a body;

attaching means for attaching the abrasive sheet material to the body on four sides such that a first portion of the abrasive sheet material forms a ninety-degree angle, a second portion of the abrasive sheet material forms an area at least 6 inches in length and 1.5 inches in width, and a third portion of the abrasive sheet material is rounded;

wherein said body comprises a top, a bottom, a first side, a second side, a first end, and a second end, said attaching means for attaching the abrasive sheet material being disposed on said first side;

wherein said attaching means for attaching the abrasive sheet material comprises a anchoring strip and a groove disposed on said first side of said body for receiving said anchoring strip;

wherein said groove is defined by first and second opposing sidewalls that are inter-coupled by a bottom wall, said groove being configured and dimensioned to receive the anchoring strip thereinto such that receiving gaps reside between the sidewalls and the anchoring strip, respectively;

wherein the anchoring strip has a length, a width, and a thickness, and wherein the width is greater than the thickness, such that the receiving gaps are smaller when the anchoring strip resides with its width spanning the groove, and the receiving gaps are larger when the anchoring strip resides with its thickness spanning the groove.

86. The sanding device of claim 85 wherein said abrasive sheet material comprises one of the group consisting of sand paper and sanding screen.

87. The sanding device of claim 85, wherein said anchoring strip is sized to hold the abrasive sheet material in the groove with a friction fit.

88. The sanding device of claim 85, wherein the anchoring strip is insertable in the groove to grip the abrasive sheet material for attachment to the groove, and the anchoring strip is removable from the groove to change the abrasive sheet material.

89. The sanding device of claim 85, wherein the anchoring strip has a rectangular cross section.

90. The sanding device of claim 85, wherein said body is constructed of a solid plastic material.

91. The sanding device of claim 85, wherein the body further comprises first and second opposing ledges that are formed in part by the first and second opposing sidewalls, respectively.

92. The sanding device of claim 85, wherein the second side of the body is rounded such that a boundary of the rounded portion forms a partial circle, wherein a radius of curvature of said rounded portion is that of a circle.

93. The sanding device of claim 85, wherein the first side of the body forms an elongate corner with the top and the bottom, and wherein at least a majority of said elongate corner is characterized by an absence of rounding.

94. A sanding device comprising:

an elongate body having a length bounded by a first end and an opposing second end, and a width bounded by a first side and an opposing second side, and a thickness bounded by a top surface and a bottom surface, wherein the first side is substantially planer and wherein the opposing second side is rounded;

attaching means for attaching opposing ends of a sheet of abrasive material to the first side of the body with said sheet of abrasive material wrapped about the body;

wherein the attaching means further comprises an elongate anchor strip;

wherein the first side of the body has an elongate opening formed therein, said elongate opening being defined by first and second opposing sidewalls that are intercoupled by a bottom wall, said elongate opening being configured and dimensioned to receive the elongate anchor strip thereinto such that receiving gaps reside between the sidewalls and the anchor strip, respectively;

wherein the anchor strip has a length, a width, and a thickness, and wherein the width of the anchor strip is greater than the thickness of the anchor strip, such that the receiving gaps are smaller when the anchor strip resides with its width spanning the elongate opening, and the receiving gaps are larger when the anchor strip resides with its thickness spanning the elongate opening;

wherein the elongate opening resides substantially equidistantly between the top surface and the bottom surface of the sanding device;

wherein the body further comprises first and second opposing ledges that are formed in part by the first and second opposing sidewalls, respectively;

wherein an average width of the elongate opening is equivalent to an average width of both of the ledges, such that said elongate opening and the first and second ledges all have substantially equivalent average widths;

wherein the anchor strip has a rectangular cross-section;

wherein the anchor strip is separate from, and unattached to, the body, such that the anchor strip is removably insertable into the elongate opening formed in the first side of the body;

wherein the anchor strip is characterized by an absence of any openings or recesses formed therein;

wherein the second side of the body is rounded such that a boundary of the rounded portion forms a partial circle, wherein a radius of curvature of said rounded portion is that of a circle;

wherein the first side of the body forms an elongate corner with the top surface and the bottom surface, and wherein at least a majority of said elongate corner is characterized by an absence of rounding;

wherein the top surface and the bottom surface are substantially planer.

95. A sanding device comprising:

an elongate body having a length bounded by a first end and an opposing second end, and a width bounded by a first side and an opposing second side, and a thickness bounded by a top surface and a bottom surface, wherein the first side is substantially planer and wherein the opposing second side is rounded;

attaching means for attaching opposing ends of a sheet of abrasive material to the first side of the body with said sheet of abrasive material wrapped about the body, such that said attaching means are characterized by an absence of a portion protruding away from said body beyond said first side when said attaching means are attached to said body;

wherein said top surface and said bottom surface comprise an area that is larger than an area defined by said first side and said second side, such that said top surface and said bottom surface provide stable surfaces for applying sanding forces without causing the sanding device to roll;

wherein the attaching means further comprises an elongate anchor strip;

wherein the first side of the body has an elongate opening formed therein, said elongate opening being defined by first and second opposing sidewalls that are intercoupled by a bottom wall, said elongate opening being configured and dimensioned to receive the elongate anchor strip thereinto such that receiving gaps reside between the sidewalls and the anchor strip, respectively;

wherein the anchor strip is separate from, and unattached to, the body, such that the anchor strip is removably insertable into the elongate opening formed in the first side of the body;

wherein the anchor strip has a length, a width, and a thickness, and wherein the width is substantially equal to the thickness, such that the receiving gaps are substantially the same size when the anchor strip resides with its width spanning the elongate opening, as when the anchor strip resides with its thickness spanning the elongate opening;

wherein the attaching means is configured for attaching said abrasive material to said body along the entire length of the body; and wherein the length of the anchor strip is no longer than the length of the body such that when the anchor strip resides in the elongate opening, the anchor strip does not protrude outside of the elongate opening.

* * * * *